United States Patent [19]

Rossmann et al.

[11] 3,945,101

[45] Mar. 23, 1976

[54] ROTOR WHEEL FOR RADIAL-FLOW FANS AND TURBINES AND METHOD AND FIXTURE FOR MAKING SAME

[75] Inventors: Axel Rossmann, Karlsfeld; Klaus Hagemeister, Munich, both of Germany

[73] Assignee: Motoren-und Turbinen Union Munich GmbH, Germany

[22] Filed: Feb. 22, 1974

[21] Appl. No.: 444,857

[30] Foreign Application Priority Data

Feb. 22, 1973 Germany ..... 2308672

[52] U.S. Cl. ..... 29/156.8 CF; 416/185; 416/213 A; 228/107

[51] Int. Cl.[2] ..... B23P 15/04

[58] Field of Search ..... 416/180, 185, 213, 188; 29/156.8 CF, 156.8 FC, 470.1, 486, 497.5, 421 E; 228/107

[56] References Cited

UNITED STATES PATENTS

| | | | |
|---|---|---|---|
| 1,571,735 | 2/1926 | Queisser | 416/185 |
| 2,324,011 | 7/1943 | Miller | 416/185 |
| 2,807,871 | 10/1957 | Wagner et al. | 29/156.8 CF |
| 2,823,008 | 2/1958 | Grey | 416/188 X |
| 3,137,937 | 6/1964 | Cowan et al. | 29/486 |
| 3,224,079 | 12/1965 | Dybvig | 29/156.8 CF |
| 3,258,841 | 7/1966 | Popoff | 29/486 |
| 3,263,323 | 8/1966 | Maher et al. | 29/421 E |
| 3,316,627 | 5/1967 | Suzuki et al. | 29/421 E |
| 3,325,075 | 6/1967 | Higuchi et al. | 228/3 |
| 3,419,951 | 1/1969 | Carlson | 29/497.5 |
| 3,521,973 | 7/1970 | Schouw | 416/185 |
| 3,673,659 | 7/1972 | Ishii et al. | 29/156.8 CF |

*Primary Examiner*—C. W. Lanham
*Assistant Examiner*—Dan C. Crane
*Attorney, Agent, or Firm*—Craig & Antonelli

[57] ABSTRACT

Sheet metal rotor wheel for radial-flow fans, turbines, and the like, and method and fixture for manufacturing same by use of explosion welding of a rotor dish to angled legs of the individual rotor blades. The individual rotor blades are formed of a T-shaped cross-section by joining two L-shaped cross-sections together by spot welding, brazing, or the like. The blades are then positioned in a fixture in predetermined relative positions corresponding to their final positions on an assembled rotor wheel. The fixture includes a rigid outer ring having an inner radius corresponding to the outer radius of the rotor wheel. The fixture also includes spacer members having gaps therebetween for holding the blades in position within the ring. The spacer members have an outer configuration corresponding to the configuration of a rotor dish, which rotor dish is held at a spacing from the angled legs of the blades, the rotor dish being covered with a layer of explosive material. The explosive material is then ignited at the point of the smallest diameter of the rotor dish, with a subsequent explosion welding of the rotor dish to the angled legs of the blades. The fixture includes grooves for accommodating the angled legs of the blade during the welding step.

2 Claims, 4 Drawing Figures

ROTOR WHEEL FOR RADIAL-FLOW FANS AND TURBINES AND METHOD AND FIXTURE FOR MAKING SAME

BACKGROUND AND SUMMARY OF THE INVENTION

This invention relates to a fabricated rotor wheel of sheet metal for radial-flow fans, turbines, and the like, where the sheet metal blades have angled legs for attachment to a suitably configured sheet metal rotor dish.

On a rotor wheel disclosed by German Pat. No. 809,690, the sheet metal blades are attached by welding, and more particularly, the blades have angled legs for attachment by projection welding.

While sheet metal rotor wheels having blades attached to them by conventional welding (above-mentioned German Patent) afford an improvement over earlier constructions where the blades were riveted into place, they nevertheless suffer from the disadvantage that they are not suitable for elevated rotational speeds because conventional welding fails to give them the requisite strength. The reason for this is that fitting the blade legs to the sheet metal dish of the rotor wheel before welding is very difficult and that for lack of time it cannot normally be performed with the necessary high degree of accuracy, so that the weld will lack adequate homogeneity. A further disadvantage of these welded rotor wheels is that conventional welding methods cause excessive distortion of the rotor wheel which is very difficult to eliminate afterwards and thus cause eccentricities which at high rotational speeds produce severe unbalances in the rotor wheel. A still further disadvantage of such welded rotor wheels is that welding contaminates the surfaces in contact with fluid flow in use of the rotor wheel and such contaminated surfaces, which are difficult to eliminate, add to the losses during flow through the rotor wheel.

Conventional welding as in the above-mentioned German Patent further poses practically insurmountable problems when the blades on the wheel are closely spaced together or when the rotor wheels are a small size, because the working space allowed for welding would then be inadequate.

The present invention contemplates providing a rotor wheel for radial-flow fans and turbines which is suitable for use at extremely high rotational speeds and where, accordingly, the joint between the blades and the wheel dish exhibits a maximum of strength. The rotor wheel contemplated by this invention likewise shows a clean surface and a high degree of centricity, these properties being achieved with a small amount of manufacturing effort.

The present invention more particularly contemplates providing a rotor wheel where the sheet metal blades are attached to the rotor dish by means of explosion welding.

An explosion-welded rotor wheel according to the present invention meets the cited requirements with entire satisfaction, giving a high-strength joint, little distortion, and a clean surface while economizing the cost of manufacture. The great strength of the joint is achieved primarily by a 100% contact weld between the bearing surface of the blade legs and the wheel dish. Manufacturing cost is economized by joining all the blades to the wheel dish in a single operation and by producing the joint at the speed of explosion.

In a further aspect of the present invention the sheet metal blades are of T-shaped cross-section formed by joining together two L-shaped blade portions. The advantage afforded by this construction is that it provides the contact surface needed for a sound joint while avoiding the high notch stresses that would be sure to occur in the outer edge of the angled blade stem if use were made of singly bent sheet blades of L-shape.

In a further aspect of this invention the two blade portions are joined together by brazing or spot welding. Sheet blades made in this manner are characterized by economy in manufacture, and they will fully meet the strength requirements since no severe stresses will occur in use in the location where the two blade portions are joined together.

The present invention further contemplates a method of manufacturing a rotor wheel assembled in accordance with the foregoing detailed description, said method being characterized by the following successive operations:

The rotor dish, with a thin layer of explosive applied to its radially inner surface, is then held over the blade legs at a short distance from them. The explosive is finally ignited using suitable means at the smallest internal diameter of the rotor dish. The explosion, its front traveling outward from the point of ignition, joins the dish to the blade legs by an action which compares to rolling under high pressure. In the process the dish is welded to the blade legs.

The prime advantages in this method are the great strength of the weld joint, the rapidity of joining, and ultimately the repeatability of the joining process, where manual operations are eliminated altogether in the welding and assurance is provided that the rotor wheels formed by the method of the present invention are interchangeable inasmuch as the strength of the blade-to-dish joint will not vary from one wheel to the next. Another benefit is that subsequent treatment of the rotor wheel, such as stress relieving or cleaning of the surface, is obviated. Cleaning is required solely on the smooth side of the rotor dish, the one pointing away from the flow and blades.

The present invention further contemplates providing apparatus for implementing the cited method, said apparatus being characterized as follows: Arranged on a horizontal, disc-shaped base plate is an outer, high-strength supporting ring the internal diameter of which is equal to the outer diameter of the rotor wheel. Placed inside the supporting ring is a number of supporting segments which corresponds to the number of blades on the wheel where, in keeping with the shape of the blades, a preferably radially extending gap the width of the thickness of a blade is allowed to remain between adjacent segments. The surface of the supporting segments exhibits the contour of the wheel dish, where depressions are provided in the gap areas which exhibit the contours of the blade legs and the depth of which is equal to the thickness of the blade legs.

The advantage in this apparatus is that it simply but nevertheless adequately supports the sheet blades to be welded to the runner or wheel dish and that the particular configuration of the surface of the supporting segments permits a weld to be achieved which is free from edge gaps and thus shows an excellent surface finish.

Further objects and advantages of the present invention are described more fully in light of the accompanying drawings.

DETAILED DESCRIPTION OF THE DRAWINGS

Figure 2A:
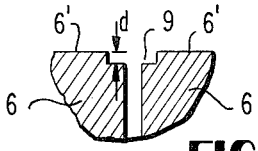
FIG. 2A is an enlarged sectional view, taken along line A—A of FIG. 2.
Figure 2:
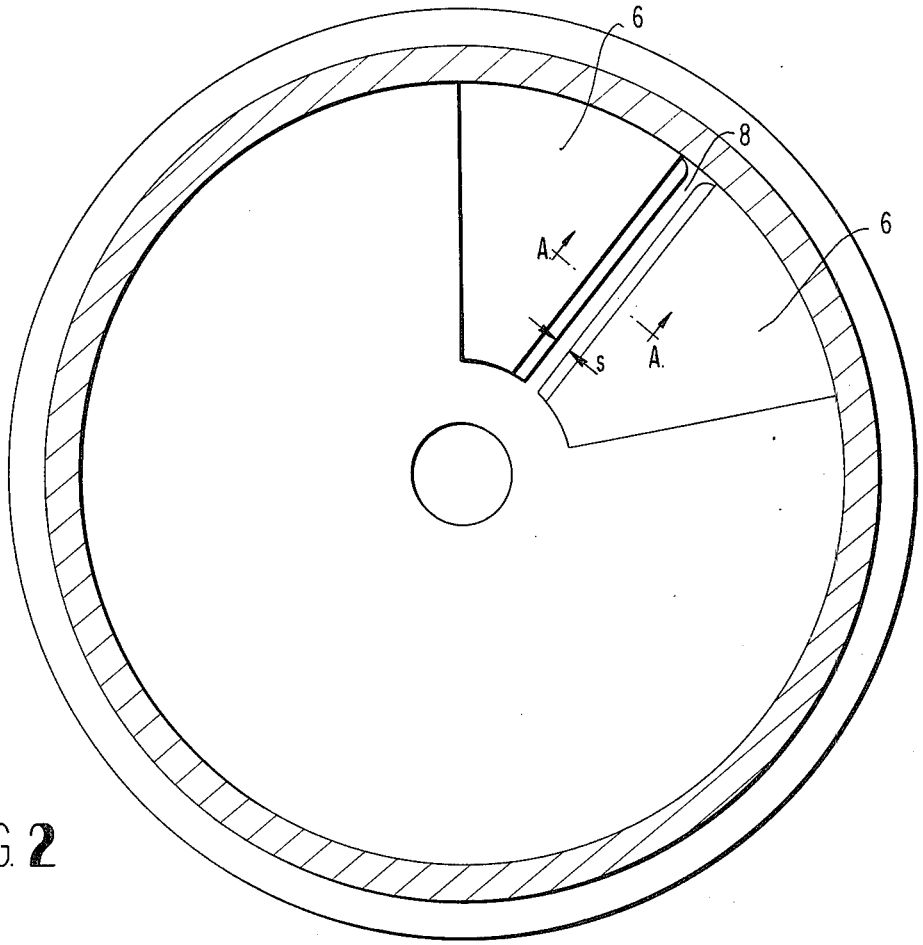
FIG. 2 is a top view which illustrates a portion of the welding fixture shown in FIG. 1.

Arranged on a horizontal, disk-shaped base plate 7 is a high-strength outer supporting ring 5, the inner diameter of which is equal to the outer diameter of the rotor wheel. Placed inside the supporting ring 5 is a number of supporting segments 6 which corresponds to the number of blades on the wheel where, in keeping with the shape of the blades, a preferably radially extending gap 8 having the width "*s*" of the thickness of a blade is allowed to remain between adjacent segments 6 (see FIG. 2). The surface 6' of the supporting segments 6 exhibits the contour of the rotor dish 1. Depressions 9 are provided in surface 6' in the gap area 8 which exhibit the contours of the blade legs 2 and the depth "*d*" of which is approximately equal to the thickness of the blade legs 2.

Figure 3:
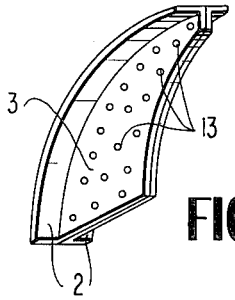
FIG. 3 is an oblique view which illustrates a sheet metal blade for a rotor wheel assembled in accordance with the present invention.

The sheet blades are seated in the gaps 8 such that the blade legs 2 come to rest in the depressions 9. The rotor wheel blades are a T-shape formed by welding two L-shaped blade portions together (see FIG. 3). The numeral 13 generally indicates the spots produced by spot-welding the blade 3.

Figure 1:
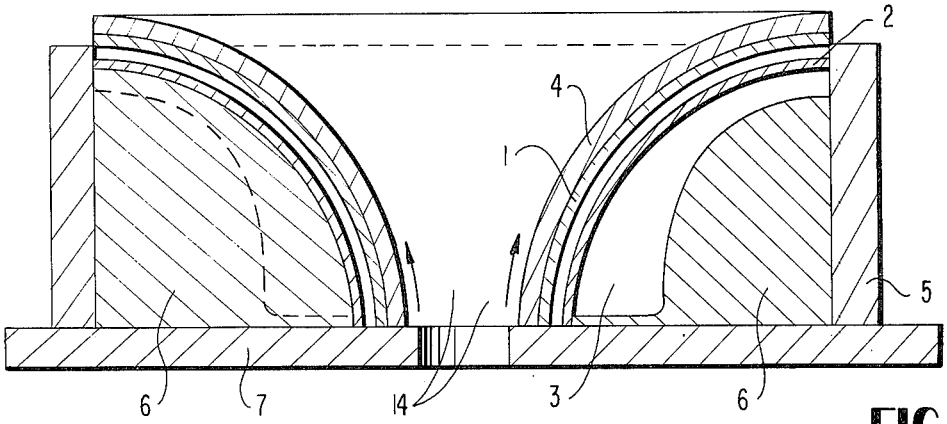
FIG. 1 is a sectional side view which illustrates apparatus according to the present invention for implementing the welding method according to the present invention, with sheet blades and a rotor wheel dish seated for explosion welding.

For welding the rotor wheel dish 1 to the sheet metal blades seated in the fixture, the wheel dish is held spaced from the blade legs at a small, maximally 5 mm distance from them. A thin layer 4 of explosive has been applied to the radially inner surface of the sheet metal dish 1. This layer of explosive preferably takes the form of an explosive foil. For welding, the explosive is ignited by suitable means at the point 14 of the smallest inner diameter of rotor wheel dish 1. From there, the explosion front spreads in the direction of the arrowheads shown in FIG. 1, rolling the rotor dish 1 onto the legs 2 of the rotor blades under great pressure and thus welding the components one to the other.

Quenched and subsequently tempered steel can be used as the material for the blade and a mar-aging steel (for example, AMS 65/20 18Ni (250) mar-aging) can be used as the material for the rotor wheel dish. The explosive can be plastic explosive of medium brisance. These materials are only given by way of example to assist those skilled in the art in practicing the invention, and are not intended to limit the scope of the invention.

The configuration of the wheel dish, as illustrated and described, is such as to properly control and direct the explosive forces for the explosive welding operation, with the explosive material being ignited at position 14.

The spacing between the rotor wheel dish and the blade legs is preferably smaller than 5 mm. and in an especially preferred embodiment, approximately 1 mm. The spacing is maintained by putting the wheel dish with its bottom end on the base plate 7.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Method of manufacturing a sheet metal rotor wheel for radial flow fans, turbines, and the like, comprising:

positioning rotor blades in a fixture in predetermined positions corresponding to the desired final relative positions they are to occupy on the rotor wheel, providing a sheet metal rotor dish with a layer of explosive on the radially inner surface thereof, placing the sheet metal rotor dish in said fixture at a small spacing from the rotor blades, and igniting said explosive to explosive weld said dish to said blades, wherein the inner diameter of said rotor dish varies along the axial length of said rotor dish, and wherein said igniting includes igniting said explosive at the smallest inner diameter of said rotor dish such that the explosive weld is formed with sequential pressing of said rotor dish against the blades in the direction of increasing diameter of said rotor dish.

2. Method according to claim 1, further comprising fabricating each of said blades by connecting two blade portions of L-shaped cross-section to one another to form a blade of T-shaped cross-section with the arms of the T constituting angled leg portions, and wherein said placing of the rotor dish includes placing the dish intermediate said angled leg portions and said layer of explosive.

* * * * *